US008697623B2

(12) United States Patent
Souter et al.

(10) Patent No.: US 8,697,623 B2
(45) Date of Patent: Apr. 15, 2014

(54) DETERGENT COMPOSITION

(71) Applicant: The Procter & Gamble Company, Cincinnati, OH (US)

(72) Inventors: Philip Frank Souter, Northumberland (GB); Nigel Patrick Somerville Roberts, Northumberland (GB); Michelle Meek, Tyne & Wear (GB); Jose David Baez Chavez, Newcastle-Upon-Tyne (GB); Mohammed Badrulhisham Bahari, Newcastle-Upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/867,280

(22) Filed: Apr. 22, 2013

(65) Prior Publication Data

US 2013/0217607 A1 Aug. 22, 2013

Related U.S. Application Data

(63) Continuation of application No. 12/692,761, filed on Jan. 25, 2010, now abandoned.

(30) Foreign Application Priority Data

Feb. 9, 2009 (EP) ..... 09152415

(51) Int. Cl.

| | |
|---|---|
| ***C11D 17/00*** | (2006.01) |
| ***C11D 11/00*** | (2006.01) |
| ***C11D 3/386*** | (2006.01) |
| ***C11D 3/395*** | (2006.01) |

(52) U.S. Cl.

USPC ..... 510/220; 510/224; 510/226; 510/375; 510/392; 510/438; 510/439; 510/441; 510/446

(58) Field of Classification Search

USPC ..... 510/220, 226, 305, 349, 374, 375, 392, 510/438, 296, 439, 446, 224, 441

See application file for complete search history.

(56) References Cited

U.S. PATENT DOCUMENTS

| | | | | |
|---|---|---|---|---|
| 3,650,961 | A * | 3/1972 | Hudson | 510/530 |
| 5,258,133 | A | 11/1993 | Chapple | |
| 5,324,649 | A | 6/1994 | Arnold et al. | |
| 5,773,400 | A | 6/1998 | Baillely et al. | |
| 6,602,841 | B1 | 8/2003 | Becker et al. | |
| 7,012,052 | B1 | 3/2006 | Kluesener et al. | |
| 7,956,027 | B2 | 6/2011 | Leininger et al. | |
| 2006/0154841 | A1 | 7/2006 | Jakob et al. | |
| 2007/0015674 | A1 | 1/2007 | Song et al. | |
| 2008/0206830 | A1 | 8/2008 | Becker et al. | |
| 2009/0137448 | A1 | 5/2009 | Leininger et al. | |
| 2010/0035060 | A1 | 2/2010 | Leininger et al. | |
| 2010/0035950 | A1 | 2/2010 | Leininger et al. | |
| 2010/0125046 | A1 * | 5/2010 | Denome et al. | 510/220 |

FOREIGN PATENT DOCUMENTS

| | | | |
|---|---|---|---|
| EP | 0 546 815 | A1 | 6/1993 |
| WO | WO 97/23606 | A1 | 7/1997 |
| WO | WO 2008/012184 | A1 * | 1/2008 |

OTHER PUBLICATIONS

PCT International Search Report, 5 Pages, Mailed Apr. 26, 2010, PCT/US2010/022155.

* cited by examiner

*Primary Examiner* — Lorna M Douyon

(74) *Attorney, Agent, or Firm* — James F. McBride; Steven W. Miller

(57) ABSTRACT

An automatic dishwashing detergent composition comprising by weight of the composition:

a) at least 9% of coated bleach particles the particles having a coating comprising at least 5% by weight of the particle of an efflorescent material;

b) at least 0.5% of granulates containing active enzyme wherein the granulates comprise efflorescent material.

23 Claims, No Drawings

DETERGENT COMPOSITION

TECHNICAL FIELD

The present invention is in the field of detergents. In particular, it relates to an automatic dishwashing detergent composition, preferably in unit dose form. More particularly, to an automatic dishwashing composition comprising a high level of coated bleach particles and enzymes-containing granules wherein the coating of the bleach particles and the enzyme-containing granules comprise an efflorescent material. The composition is robust in terms of storage properties and processing even when subjected to variable temperature cycles.

BACKGROUND

Powder handling is a very a complex issue. Powder properties greatly vary with the conditions of the environment surrounding the powder, such as humidity and temperature. Temperature changes often affect powders faster than ambient humidity changes—especially if there is any protection around the powder. In particular powder properties can be greatly affected by temperature cycles. Powders can be subjected at temperature changes and these changes from hot to cold and vice-versa have processing issues associated to them. It has been found that, especially under cold conditions (for example at night time), powder temperatures in manufacturing plants and/or warehouses (where powders are stored) can fall below the dew point of the powder. Under these conditions moisture in the air within the granules can condense at particles contact points and can give rise to hydrated crystal bridges etc and cause caking.

Some solutions to this problem can give rise to new problems under different temperature conditions. For example measurements taken to improve powder handling under cold conditions can give rise to problems with the same powder under hot conditions.

In view of the above discussion one of the objectives of the present invention is to provide a detergent composition which is resistant to temperature changes. The detergent composition of the invention also needs to be stable in storage under a whole range of environmental conditions. The detergent composition of the invention should also have an excellent cleaning profile.

SUMMARY OF INVENTION

According to a first aspect of the invention, there is provided an automatic dishwashing detergent composition, the composition is a solid composition. The composition comprises:

a) at least 8%, preferably from about 9% to about 25%, more preferably from about 10% to about 20% by weight of the composition of coated bleach particles. The particles comprise at least 4%, preferably from about 5% to about 20%, more preferably from about 6% to about 15% by weight of the particle of an efflorescent material, in the form of a coating; and b) at least 0.5%, preferably from about 0.8% to about 5%, more preferably from about 1% to about 2% by weight of the composition of granulates containing active enzyme wherein the granulates comprise at least 30%, preferably from about 35% to about 70%, more preferably from about 40% to about 60% by weight of the granulate and wherein the efflorescent material and the active enzyme are in a weight ratio of at least 4:1, preferably at least 5:1, more preferably from 4:1 to 20:1 and especially from 5:1 to 10:1.

The granulates have a high level of active enzyme and they are stable in the composition of the invention. Due to the high enzymatic activity of the granulates they are suitable for use in compact detergents. In order for the composition to present improved storage stability it is needed that both bleach is coated with an efflorescent material and enzyme granulates comprise a high level of efflorescent material.

According to a second aspect of the invention, there is provided an automatic dishwashing detergent composition, the composition is a solid composition. The composition comprises:

a.) at least 8%, preferably from about 9% to about 25%, more preferably from about 10% to about 20% by weight of the composition of coated bleach particles. The particles comprise at least 4%, preferably from about 5% to about 20%, more preferably from about 6% to about 15% by weight of the particle of an efflorescent material, in the form of a coating; and b.) at least 0.5%, preferably from about 0.8 to about 5%, more preferably from about 1% to about 2% by weight of the composition of granulates containing active enzyme wherein the granulates comprise at least 40%, preferably from about 50% to about 80%, more preferably from about 55% to about 65% by weight of the granulate. Preferably the granulate comprises at least 1% of active enzyme, more preferably at least 2%, even more preferably from about 1% to about 10% and especially from about 2% to about 5%.

Cold conditions, can give rise to water condensation that can promote caking, negatively affecting the flowability and handling of automatic detergent powders. Ideally the powder should be versatile enough to take water at low temperature and release it at high temperature. Some anhydrous materials (hygrocopic materials) have a strong tendency to absorb water vapour from the air, thus becoming hydrated compounds. Some of these materials absorb water to such an extent that they actually dissolve in the water that they take up (deliquescent materials). Some other anhydrous materials absorb water forming permanent structures (eg stable hydrates), that tend to promote caking and affect the stability of the product. Powder compositions comprising bleach particles coated with efflorescent material and enzyme-containing granulates having a high level of efflorescent material could contribute to water intake and release without negatively affecting the powder properties and the stability of finished automatic dishwashing detergent products.

By "efflorescent material" is herein understood a material that in its anhydrous form can take water to become hydrated and it can easily give up the hydration water when it is placed in a drier or warmer environment. Preferably the efflorescent materials for use in the composition of the invention have a difference in density between the anhydrous and hydrated form of at least 0.8 g/cm3, more preferably at least 1 g/cm3 and especially at least 1.2 g/cm3. This difference in densities provides a mechanism to break particle:particle crystal bridges that have formed as a result of water condensing as the powder temperature fell below the dew point associated with that powder. As the temperature increases following a period of cooling (as in a temperature cycle), the hydrated material forming a crystal bridge between particles reverts to the anhydrous (or less hydrated) form. The higher crystal density associated with the anhydrous (or less hydrated) form provides a mechanism for breaking these crystal bridges due to the reduction in crystal volume. This allows that a period of low temperature does not negatively and permanently affect the structure of the powder and contributes to good handling properties of the composition.

Preferred efflorescent materials for use herein include sulphate and citrates, especially preferred for use herein is sodium sulphate. The efflorescent material coating the bleach can be the same or different from the efflorescent material of the enzyme granulate. Preferably the material it is the same.

Preferably the compositions of the invention are in unit dose form. Tablets and water-soluble pouches are preferred unit dose forms for use herein.

In the production process of unit dose products, it may occur that a proportion of them do not comply with the required manufacture specifications and are therefore not suitable for sale. This is especially the case for products produced during the start up and shut down of the process, i.e., before the process reaches a steady state operation.

There is a need for dealing with these "non-suitable" products (herein also referred as "waste" or "rejects") for economic and environmental reasons. An option is to convert the rejects back into powder and reusing it for making new products. The powder to be reused is not usually processed straight away and therefore it can be exposed to the environment for relatively long periods of time thus caking; flowability and handling problems can become worse than in the case of freshly made powder. The composition of the invention presents fewer processing problems even under these stressed conditions.

Preferably the weight of the composition is less than 20 grams, preferably from about 5 to about 19, more preferably from about 6 to about 18 and especially from about 7 about 12 grams. The small weight of the unit dose makes it even more challenging from a process view point because there is not much room for fillers or sacrificial materials.

In a preferred embodiment the composition comprises ethoxylated/propoxylated non-ionic surfactant. The non-ionic surfactant is usually in the form of a paste. The paste is usually sprayed onto the powder before the powder is converted into the final unit dose product. Usually a rest period (in which water can be adsorbed by the powder) is required before the conversion of the powder into the unit dose product, this is particularly important in the case of tablets. If the powder does not rest after the spraying on of the non-ionic the mixture to be tabletted is very sticky given rise to a great amount of residues in the tabletting equipment. The composition of the invention is suitable for use under these conditions.

Organic and inorganic bleaches can be used in the composition of the invention. In a preferred embodiment the bleach is an inorganic peroxide in particular percarbonate. Preferred enzymes for use herein include amylases, proteases and mixtures thereof.

Compositions comprising both, enzyme and bleach typically suffer from stability problems of the enzyme because of the detrimental effect thereon of the bleaching compound. This results in either 1) loss of performance of the enzyme and hence the detergent composition and/or 2) the need to include increased levels of the enzyme in the detergent composition thus increasing cost.

The composition of the invention presents great stability in storage, even under high humidity conditions. Both, enzyme-containing granulates and bleach, has been found stable in the composition of the invention.

In a preferred embodiment of the invention, the composition is free of phosphate builder, this is advantageous from an environmental viewpoint; however, this brings process complications. Phosphate is a hygroscopic material and contributes to the processing, handling and stability of the composition. Added complications appear when the composition further comprises materials which bring water to the composition or which are not hygroscopic such as some of the non-phosphate builder and some of the anti-scalant polymers.

The composition of the invention provides excellent cleaning and at the same time is stable under a whole range of humidity conditions and temperature cycles.

According to a third aspect of the invention, there is provided a process for making the composition of the invention.

DETAILED DESCRIPTION OF THE INVENTION

The present invention envisages an automatic dishwashing detergent composition. The composition comprises bleach particles coated with an efflorescent material and enzyme granulates containing a high level of efflorescent material. The composition is very robust in terms of temperature cycles stability. It has good handling and storage stability properties and at the same time provides excellent cleaning.

Bleach

The composition of the invention comprises coated bleach particles. The particles are coated with an efflorescent material, preferably with sulphate or citrate, more preferably with sodium sulphate. The bleach particles comprise at least 5% by weight of the particle of efflorescent material, preferably from about 5% to about 20%, more preferably from about 6% to about 15% and especially from about 7% to about 12% by weight of the particle of an efflorescent material.

Inorganic and organic bleaches are suitable bleaches for use herein. Inorganic bleaches include perhydrate salts such as perborate, percarbonate, perphosphate, persulfate and persilicate salts. The inorganic perhydrate salts are normally the alkali metal salts. Alkali metal percarbonates, particularly sodium percarbonate are preferred perhydrates for use herein. The percarbonate is incorporated into the products in a coated form which provides in-product stability and anti-caking properties.

The literature describes a large number of materials that can be used as coating for bleach, however the literature does not address the problem of caking of bleach particles or temperature cycle stable bleach particles (i.e. bleach particles capable of withstand temperature changes). For the present invention the bleach needs to be coated with efflorescent material, preferably with sulphate or citrate, more preferably with sodium sulphate. The coating can comprises other materials but preferably the coating comprises less than 40%, more preferably less than 20% and even more preferably less than 10% and especially less than 1% by weight of the coating of other materials, i.e., preferably the coating consist essentially of efflorescent materials, more preferably the coating consist essentially of sodium sulphate.

Especially preferred for use herein are percarbonate particles comprising a core substantially consisting of bleach, preferably sodium percarbonate, and a coating layer enclosing this core comprising an efflorescent material, preferably sodium sulphate. The core can be produced by fluidised bed spray granulation and the coating layer can be obtainable by spraying an aqueous efflorescent material, preferably sodium sulphate solution onto the uncoated particles of bleach. The fluidised bed temperature is from 35 to 100° C. to allow for water evaporation. In the case in which the efflorescent material is sodium sulphate, the fluidised bed temperature during application of the coating layer is maintained above the transition temperature of the decahydrate (32.4° C.).

The bleach can be coated using a plurality of processes, for example by coating in a fluidised bed. Details of the process are found at EP 862 842 A1 and U.S. Pat. No. 6,113,805.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

The diacyl peroxide, especially dibenzoyl peroxide, should preferably be present in the form of particles having a weight average diameter of from about 0.1 to about 100 microns, preferably from about 0.5 to about 30 microns, more preferably from about 1 to about 10 microns. Preferably, at least about 25%, more preferably at least about 50%, even more preferably at least about 75%, most preferably at least about 90%, of the particles are smaller than 10 microns, preferably smaller than 6 microns. Diacyl peroxides within the above particle size range have also been found to provide better stain removal especially from plastic dishware, while minimizing undesirable deposition and filming during use in automatic dishwashing machines, than larger diacyl peroxide particles. The preferred diacyl peroxide particle size thus allows the formulator to obtain good stain removal with a low level of diacyl peroxide, which reduces deposition and filming. Conversely, as diacyl peroxide particle size increases, more diacyl peroxide is needed for good stain removal, which increases deposition on surfaces encountered during the dishwashing process.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Preferably the products of the invention contain percarbonate. Also preferred are products comprising coated percarbonate and coated or uncoated PAP or coated percarbonate and coated or uncoated DAP.

Preferably, the bleach coated particles have a weight geometric mean particle size of from about 300 μm to about 1200 μm, more preferably from about 400 μm to about 1000 μm and especially from about 500 μm to about 900 μm. Preferably the bleach coated particles have low level of fines and coarse particles, in particular less than 10% by weight of the particles are above about 1400, more preferably about 1200 or below about 200, more preferably about 100 μm. These mean particle size and particle size distribution further contribute to the excellent processing properties of the composition of the invention. In especially preferred embodiments, from the processing point of view, the particles have a weight geometric mean particle size of from about 500 to about 1000 μm with less than about 3% by weight of the polymer above about 1180 μm and less than about 5% by weight of the particles below about 200 μm. The weight geometric mean particle size can be measured using a Malvern particle size analyser based on laser diffraction.

Enzyme Granulates

Suitable enzyme granulates for use herein include those formed according to any of the below technologies:

a) Spray dried products, wherein a liquid enzyme-containing solution is atomised in a spray drying tower to form small droplets which during their way down the drying tower dry to form an enzyme-containing particulate material. Very small particles can be produced this way (Michael S. Showell (editor); Powdered detergents; Surfactant Science Series; 1998; vol. 71; page 140-142; Marcel Dekker).

b) Layered products, wherein the enzyme is coated as a layer around a pre-formed inert core particle, wherein an enzyme-containing solution is atomised, typically in a fluid bed apparatus wherein the pre-formed core particles are fluidised, and the enzyme-containing solution adheres to the core particles and dries up to leave a layer of dry enzyme on the surface of the core particle. Particles of a desired size can be obtained this way if a useful core particle of the desired size can be found. This type of product is described in e.g. WO 97/23606 c) Absorbed core particles, wherein rather than coating the enzyme as a layer around the core, the enzyme is absorbed onto and/or into the surface of the core. Such a process is described in WO 97/39116.

d) Extrusion or pelletized products, wherein an enzyme-containing paste is pressed to pellets or under pressure is extruded through a small opening and cut into particles which are subsequently dried. Such particles usually have a considerable size because of the material in which the extrusion opening is made (usually a plate with bore holes) sets a limit on the allowable pressure drop over the extrusion opening. Also, very high extrusion pressures when using a small opening increase heat generation in the enzyme paste, which is harmful to the enzyme. (Michael S. Showell (editor); Powdered detergents; Surfactant Science Series; 1998; vol. 71; page 140-142; Marcel Dekker)

e) Prilled products or, wherein an enzyme powder is suspended in molten wax and the suspension is sprayed, e.g. through a rotating disk atomiser, into a cooling chamber where the droplets quickly solidify (Michael S. Showell (editor); Powdered detergents; Surfactant Science Series; 1998; vol. 71; page 140-142; Marcel Dekker). The product obtained is one wherein the enzyme is uniformly distributed throughout an inert material instead of being concentrated on its surface. Also U.S. Pat. Nos. 4,016,040 and 4,713,245 are documents relating to this technique f) Mixer granulation products, wherein an enzyme-containing liquid is added to a dry powder composition of conventional granulating components. The liquid and the powder in a suitable proportion are mixed and as the moisture of the liquid is absorbed in the dry powder, the components of the dry powder will start to adhere and agglomerate and particles will build up, forming granulates comprising the enzyme. Such a process is described in U.S. Pat. No. 4,106,991 (NOVO NORDISK) and related documents EP 170360 B1, EP 304332 B1, EP 304331, WO 90/09440 and WO 90/09428. In a particular product of this process wherein various high-shear mixers can be used as granulators, granulates consisting of the enzyme, fillers and binders etc. are mixed with cellulose fibres to reinforce the particles to give the so-called T-granulate. Reinforced particles, being more robust, release less enzymatic dust.

Preferred enzyme granulates, for use in the composition of the invention, have a core-shell structure. In preferred core-shell embodiments the core comprises a central part, preferably free of enzymes, and a surrounding layer containing enzymes and the shell comprises a plurality of layers, the most outer layer being a protective layer. In preferred embodiments the central part of the core and at least one of the layers of the shell comprise an efflorescent material. Preferably the central part of the core represents from 1% to 60%, more preferably from 3% to 50% and especially from 5% to 40% by weight of the total particle. Preferably the layer comprising the efflorescent material represents from 0.5% to 40%, more preferably from 1% to 30% and especially from 3% to 20% by weight of the total particle. Preferably the most outer layer comprises polyvinyl alcohol, more preferably titanium oxide (for aesthetic reasons) and especially a combination thereof. Preferably the protective layer represents from 0.05% to 20%, more preferably from 0.1% to 15% and especially from 1% to 3% by weight of the total particle. The enzyme granulate can also contain adjunct materials such as antioxidants, dyes, activators, solubilizers, binders, etc. Enzymes according to this embodiment can be made by a fluid bed layering process similar to that described in U.S. Pat. Nos. 5,324,649, 6,602,841 B1 and US2008/0206830A1.

Enzymes according to this embodiment can also be made by a combination of processes. Such enzyme granulates are built around a core that can be free of enzymes or contain enzymes (preferably comprising an efflorescent material, more preferably sodium sulphate) that can be made using a variety of processes including use of either a mixer granulator or an extruder. The cores are then treated in a fluid bed process wherein the enzyme is sprayed onto the core. The core is then coated by a layer, preferably comprising an efflorescent material, and more preferably sodium sulphate and finally is coated with a polymer selected from the group comprising hydroxpropylmethylcellulose and/or polyvinylalcohol and derivatives thereof, optionally also containing additional titanium dioxide, polyethylene glycol and/or kaolin or any mixtures thereof. Processes suitable for making the enzyme granulate for use herein are described in U.S. Pat. No. 6,348,442 B2, US 2004/0033927 A1, U.S. Pat. No. 7,273,736, WO 00/01793, U.S. Pat. No. 6,268,329 B1 and US2008/0206830A1. Preferably, the granulate comprises from about 30% to about 75%, preferably from about 40 to about 50% by weight of the granulate of an efflorescent material, selected from the group comprising sodium sulphate, sodium citrate and mixtures thereof, preferably sodium sulphate.

Preferably, the enzyme granulates have a weight geometric mean particle size of from about 200 μm to about 1200 μm, more preferably from about 300 μm to about 1000 μm and especially from about 400 μm to about 600 μm.

Enzyme Related Terminology

Nomenclature for Amino Acid Modifications

In describing enzyme variants herein, the following nomenclature is used for ease of reference: Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Protease Amino Acid Numbering

The numbering used in this patent is numbering versus the specific protease (PB92) listed as SEQ ID No:1. An alternative numbering scheme is the so-called BPN' numbering scheme which is commonly used in the art. For convenience the numbering schemes are compared below in Table 1:

TABLE 1

Protease Mutation numbering

| PB92 NUMBERING OF THIS PATENT (NUMBERING VERSUS SEQ ID NO: 1) | Equivalent BPN' numbering |
|---|---|
| G116V + S126L + P127Q + S128A | G118V + S128L + P129Q + S130A |
| G116V + S126N + P127S + S128A + S160D | G118V + S128N + P129S + S130A + S166D |
| G116V + S126L + P127Q + S128A + S160D | G118V + S128L + P129Q + S130A + S166D |
| G116V + S126V + P127E + S128K | G118V + S128V + P129E + S130K |
| G116V + S126V + P127M + S160D | G118V + S128V + P129M + S166D |
| S128T | S130T |
| G116V + S126F + P127L + S128T | G118V + S128F + P129L + S130T |
| G116V + S126L + P127N + S128V | G118V + S128L + P129N + S130V |
| G116V + S126F + P127Q | G118V + S128F + P129Q |
| G116V + S126V + P127E + S128K + S160D | G118V + S128V + P129E + S130K + S166D |
| G116V + S126R + P127S + S128P | G118V + S128R + P129S + S130P |
| S126R + P127Q + S128D | S126R + P129Q + S130D |
| S126C + P127R + S128D | S128LC + P129R + S130D |
| S126C + P127R + S128G | S128LC + P129R + S130G |

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of and enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Alpha-amylase

Suitable alpha-amylases for use herein include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), *Bacillus* sp. 707, KSM K36 or KSM K38 (EP 1,022,334).

Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 2:

9, 26, 30, 33, 82, 37, 106, 118, 128, 133, 149, 150, 160, 178, 182, 186, 193, 195, 202, 203, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484 that also preferably contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with SEQ ID NO:5, the wild-type enzyme from *Bacillus* sp.707, especially those comprising mutations in one or more of the following positions M202, M208, 5255, R172, and/or M261.

Suitable commercially available alpha-amylases are DURAMYL®, LIQUEZYME® TERMAMYL®, TERMAMYL ULTRA®, NATALASE®, SUPRAMYL®, STAINZYME®, STAINZYME PLUS®, FUNGAMYL® and BAN® (Novozymes A/S), BIOAMYLASE-D(G), BIOAMYLASE® L (Biocon India Ltd.), KEMZYM® AT 9000 (Biozym Ges. m.b.H, Austria), RAPIDASE®, PURASTAR®, OPTISIZE HT PLUS® and PURASTAR OXAM® (Genencor International Inc.) and KAM® (KAO, Japan). In one aspect, preferred amylases are NATALASE®, STAINZYME® and STAINZYME PLUS® and mixtures thereof.

Preferred amylases for use herein are low temperature amylases. Compositions comprising low temperature amylases allow for a more energy efficient dishwashing processes without compromising in cleaning. Also preferred for use herein is a combination of a mixture of two or more amylases, preferably the mixture comprises at least one low temperature amylase. A mixture of amylases can contribute to an enhanced cleaning across a broader temperature and/or substrate range and provide superior shine benefits, especially when used in conjunction with an anti-redeposition agent and/or a sulfonated polymer.

As used herein, "low temperature amylases" are amylases that demonstrate at least 1.2, preferably at least 1.5 and more preferably at least 2 times the relative activity of the reference amylase at 25° C. As used herein, the "reference amylase" is commercially available under the tradename of Termamyl™ (Novozymes A/S), the enzyme of SEQ ID No. 3. As used herein, "relative activity" is the fraction derived from dividing the activity of the enzyme at the temperature assayed versus its activity at its optimal temperature measured at a pH of 9.

Preferably low temperature amylases possess one or more of the following properties:

(a) greater than or equal to 60%, preferably 70%, more preferably 80% and especially 90% of their maximum activity at 50° C.

(b) greater than or equal to 30%, preferably 40%, more preferably 50%, even more preferably 60% and especially 70% of their maximum activity at 40° C.

(c) greater than or equal to 20%, preferably 30% more preferably 40% of their maximum activity at 30° C.

Activity may be determined by well-known standard amylase assays described herein below and is assayed between 20 and 90° C.

Low temperature amylases for use herein, including chemically or genetically modified mutants (variants), are alkaline amylases possessing at least 90%, preferably 95%, more preferably 98%, even more preferably 99% and especially 100% identity, with those derived from *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred low temperature amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID NO:2:

9, 26, 30, 33, 82, 37, 106, 118, 128, 133, 149, 150, 160, 178, 182, 186, 193, 195, 202, 203, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484 that also preferably contain the deletions of D183* and G184*.

(b) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference. Suitable commercially available low temperature alpha-amylases include STAINZYME®, STAINZYME PLUS®, STAINZYME ULTRA® and NATALASE® (Novozymes A/S).

(c) variants exhibiting at least 95% identity with SEQ ID NO:5, the wild-type enzyme from *Bacillus* sp.707, especially those comprising mutations in one or more of the following positions M202, M208, 5255, R172, and/or M261.

Especially preferred low temperature amylase for use herein is an amylase variant comprising either:

(a) one or more, preferably three or more substitutions in the following positions versus SEQ ID NO: 2:

9, 26, 149, 182, 186, 202, 257, 295, 299, 323, 339 and 345; and (b) optionally with one or more, preferably all of the substitutions and/or deletions in the following positions: 118, 183, 184, 195, 320 and 458, which if present preferably comprise R118K, D183*, G184*, N195F, R320K and/or R458K.

or:

(c) at least one substitution in the following positions versus SEQ ID NO:5: M202, M208, S255, R172, and/or M261. Preferably said amylase comprises one or more of M202L, M202V, M2025, M202T, M202I, M202Q, M202W, S255N and/or R172Q. Particularly preferred are those comprising the M202L or M202T mutations.

Most preferred low temperature amylases include those comprising the following sets of mutations:

(i) M9L+M323T;

(ii) M9L+M202L/T/V/I+M323T;

(iii) M9L+N195F+M202L/T/V/I+M323T;

(iv) M9L+R118K+D183*+G184*+R320K+M323T+R458K;

(v) M9L+R118K+D183*+G184*+M202L/T/V/I+R320K+M323T+R458K;

(vi) M9L+G149A+G182T+G186A+M202L+T257I+Y295F+N299Y+M323T+A339S+E345R;

(vii) M9L+G149A+G182T+G186A+M2021+T257I+Y295F+N299Y+M323T+A339S+E345R;

(viii) M9L+R118K+G149A+G182T+D183*+G184*+G186A+M202L+T257I+Y295F+N299Y+R320K+M323T+A339S+E345R+R458K;

(ix) M9L+R118K+G149A+G182T+D183*+G184*+G186A+N195F+M202L+T257I+Y295F+N299Y+R320K+M323T+A339S+E345R+R458K;

(x) M9L+R118K+G149A+G182T+D183*+G184*+G186A+M2021+T257I+Y295F+N299Y+R320K+M323T+A339S+E345R+R458K;

(xi) M9L+R118K+D183*+D184*+N195F+M202L+R320K+M323T+R458K;

(xii) M9L+R118K+D183*+D184*+N195F+M202T+R320K+M323T+R458K;

(xiii) M9L+R118K+D183*+D184*+N195F+M2021+R320K+M323T+R458K;

(xiv) M9L+R118K+D183*+D184*+N195F+M202V+R320K+M323T+R458K;

(xv) M9L+R118K+N150H+ D183*+D184*+N195F+M202L+V214T+R320K+M323T+R458K; or (xvi) M9L+R118K+D183*+D184*+N195F+M202L+V214T+R320K+M323T+E345N+R458K.

The amylase sold under the tradename STAINZYME PLUS® is the most preferred.

A high temperature amylase is characterized in that it has a relative activity of less than 0.25 or typically less than 0.2 at a pH of 9 and a temperature of 25° C. An example of such an enzyme would be the reference enzyme of this test, Termamyl™, the wild-type enzyme from *Bacillus licheniformis*, whose sequence is SEQ ID No:3.

Assay for Alpha-Amylase Activity

Amylase activity is measured using a maltoheptaoside modified with a p-Nitrophenol chromophore (Infinity Amylase Reagent from Thermo Electron, Woburn, Mass., USA, Cat #: TR25421). Release of the chromophore is initiated via amylase action. Amylase activity is measured initially in AMU's. 1 AMU (amylase unit) is the amount of enzyme which hydrolyzes PNP-G7 (p-nitrophenyl-alpha,D-maltoheptaoside) carbohydrate substrate such that the initial rate of formation of small carbohydrates (G2-4) per minute corresponds to 1 μmole of 4-Nitrophenol per minute.

The test is run versus a reference enzyme, that of SEQ ID No:3 sold under the tradename Termamyl™ (Novozymes A/S). These amylase units (AMUs) are converted into a unit of KNU, using the conversion factor 0.133 mg of Termamyl™ corresponds to 1 KNU. Therefore if using the above assay the enzyme sample shows an activity equivalent to that shown by 0.266 mg of Termamyl™, its activity is considered to be 2 KNU.

Analysis

200 μL of dilute enzyme containing sample is added to 2500 μL of Infinity amylase reagent. Mix and incubate at 37° C. for 4.5 minutes. The absorbance is read at 415 nm.

Preferably, the low temperature amylase in the composition of the invention has an activity of at least 6 KNU, more preferably at least 7.5 KNU per gram of detergent composition.

Protease

Suitable proteases include metalloproteases and serine proteases, including neutral or alkaline microbial serine proteases, such as subtilisins (EC 3.4.21.62). Suitable proteases include those of animal, vegetable or microbial origin. Microbial origin is preferred. Chemically or genetically modified mutants are included. The protease may be a serine protease, preferably an alkaline microbial protease or a chymotrypsin or trypsin-like protease. Examples of neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. Nos. 5,679,630, 4,760,025, DE102006022216A1 and DE102006022224A1.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044,993A2.

Suitable commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase®, and Purafect OXP® by Genencor International, and those sold under the tradename Opticlean® and Optimase® by Solvay Enzymes.

In the composition of the invention a mixture of two or more proteases may be used, such mixtures comprising at least one low temperature protease are preferred for use herein. A mixture of proteases can contribute to an enhanced cleaning across a broader temperature and/or substrate range and provide superior shine benefits, especially when used in conjunction with an anti-redeposition agent and/or a sulfonated polymer.

Low-temperature Protease

Proteases commonly used in detergents are highly effective at high temperatures of 50° C. and in particular 60° C. One such commonly used protease is the wild-type subtilisin protease of *Bacillus lentus*, sold under the tradenames of Savinase™ or Purafect™ and described below as the reference protease.

It has been found that it can be particularly advantageous for one or more of the proteases present in the composition of the invention to be a low temperature protease. As used herein, "low temperature protease" is a protease that demonstrates at least 1.2, preferably at least 1.5 and more preferably at least 2 times the relative activity of the reference protease at 25° C. As used herein, the "reference protease" is the wild-type subtilisin protease of *Bacillus lentus*, commercially available under the tradenames of Savinase™ or Purafect™ and whose sequence is SEQ ID No:4. As used herein, "relative activity" is the fraction derived from dividing the activity of the enzyme at the temperature assayed versus its activity at its optimal temperature measured at a pH of 9.

Low temperature proteases for use herein include polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference:

68, 87, 99, 101, 103, 104, 118, 128, 129, 130, 167, 170, 194, 205 & 222

Preferably, the mutations are selected from one or more, preferably two or more and more preferably three or more of the following: V68A, S87N, S99D, S101G, S103A, V104N/I, Y167A, R170S, A194P, V205I and/or M222S.

If compared directly to the enzyme of SEQ ID NO:4, the above sets of mutations correspond to mutations in the following positions:

66, 85, 97, 99, 101, 102, 116, 126, 127, 128, 161, 164, 188, 199 & 216

Preferably, the mutations are selected from one or more, preferably two or more and more preferably three or more of the following versus the enzyme of SEQ ID NO:4:

V66A, S85N, S97D, S99G, S101A, V102N/I, Y161A, R164S, A188P, V199I and/or M216S.

Most preferably the protease is selected from the group comprising the below mutations versus SEQ ID NO:1 (mutation numbering is directly versus SEQ ID NO:1, rather than the BPN' numbering):

(i) G116V+S126L+P127Q+S128A
(ii) G116V+S126N+P127S+S128A+5160D
(iii) G116V+S126L+P127Q+S128A+5160D
(iv) G116V+S126V+P127E+S128K
(v) G116V+S126V+P127M+5160D
(vi) G116V+S126F+P127L+S128T
(vii) G116V+S126L+P127N+S128V
(viii) G116V+S 126F+P127Q
(ix) G116V+S126V+P127E+S128K+5160D
(x) G116V+S126R+P127S+S128P
(xi) S126R+P127Q+S128D
(xii) S126C+P127R+S128D
(xiii) S126C+P127R+S128G
(xiv) S99G+V102N
(xv) N74D+N85S+S101A+V102I
(xvi) V66A+N85S+S99G+V102N Examples of such low temperature proteases include Polarzyme™, (Novozymes A/S, Bagsvaerd, Denmark), Properase™, Properase BS™, FN3™, FN4™ and Excellase® (Genencor International Inc., Palo Alto, Calif., USA).

A high temperature protease is characterized in that it has a relative activity of greater than or equal to that of the wild-type from *Bacillus lentus*, sold under the tradenames Savinase™ or Purafect™ at a pH of 9 and a temperature of 60° C. In a preferred embodiment, said high temperature protease is Savinase™ or Purafect™. As used herein, "relative activity" is the fraction derived from dividing the activity of the enzyme at the temperature assayed versus its activity at its optimal temperature measured at a pH of 9.

Assay for Protease Activity

Protease activity is measured using Dimethyl Casein (DMC). Release of peptides is initiated via protease action. Protease activity is measured in PU's. 1 PU (protease unit) is the amount of enzyme which hydrolyzes casein such that the initial rate of formation of peptides per minute corresponds to 1 μmole of glycine per minute. 1 KPU is equal to 1000 protease units.

Analysis

A 2,4,6 Trinitrobenzenesulphonic acid (TNBSA) solution and a DMC solution are prepared. All ingredients are from Sigma-Aldrich, Milwaukee, USA, unless otherwise stated. The TNBSA solution is made by dissolving 0.40 mL of TNBSA (Sigma Cat No P-2297) in 50 mL of deionized water. The DMC solution is made by dissolving 5.09 g of Potassium Chloride (Sigma Catalogue No: P-3911) and 1.545 g of Boric Acid (Sigma Catalogue No: B-0399) in 500 mL of deionized water. The solution is stirred for 10 mins to dissolve and then the pH adjusted to 9.0 using 50% NaOH. 2 g of DMC are then added (DMC, British Drug House, Cat No. 79457) and the solution is stirred to dissolve.

100 μL of a dilute enzyme containing sample is added (0.5% sodium sulfite solution with 0.04% calcium chloride; Sigma Catalogue No: S-6672 and Sigma Catalogue No: C-5080, respectively) to 1800 μL of DMC solution. The resultant solution is mixed and incubated at 37° C. for 4 minutes. Then 900 μL of TNBSA solution are added to the mixture and incubated for another 5 minutes. The absorbance is read at 415 nm.

Preferably, the variant protease of the invention has an activity of at least 0.3 KNPU per gram of composition, more preferably at least 0.7 KNPU per gram of composition and especially 1 KNPU per gram of composition.

Additional Enzymes

Additional enzymes suitable for use in the composition of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

In preferred embodiments, such additional enzyme may be selected from the group consisting of lipases, including "first cycle lipases" comprising a substitution of an electrically neutral or negatively charged amino acid with R or K at any of positions 3, 224, 229, 231 and 233 on the wild-type of *Humicola Lanuginosa*, whose sequence is shown as SEQ ID No 1 in pages 5 and 6 of U.S. Pat. No. 6,939,702 B1, preferably a variant comprising T231R and N233R mutations. One such preferred variant is sold under the tradename Lipex® (Novozymes A/S, Bagsvaerd, Denmark).

Cleaning Actives

Any cleaning ingredient can be used as part of the product of the invention. The levels given are weight percent and refer to the total composition (excluding the enveloping water-soluble material, in the case of unit dose forms having a wrapper or enveloping material). The composition can contain a phosphate builder or be free of phosphate builder and comprise one or more detergent active components which may be selected from bleach activator, bleach catalyst, surfactants, alkalinity sources, anti-scaling polymers, anti-corrosion agents (e.g. sodium silicate) and care agents. Highly preferred cleaning components for use herein include a builder compound, an alkalinity source, a surfactant, an anti-scaling polymer (preferably a sulfonated polymer), an enzyme and an additional bleaching agent.

Surfactant

Surfactants suitable for use herein include non-ionic surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the product of the invention comprises is a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Preferably non-ionic surfactants and/or system to use as anti-redeposition agents herein have a Draves wetting time of less than 360 seconds, preferably less than 200 seconds, more preferably less than 100 seconds and especially less than 60 seconds as measured by the Draves wetting method (standard method ISO 8022 using the following conditions; 3-g hook, 5-g cotton skein, 0.1% by weight aqueous solution at a temperature of 25° C.).

Amine oxides surfactants are also useful in the present invention as anti-redeposition surfactants include linear and branched compounds having the formula:

$$R3(OR4)_xN^{+}(R5)_2 \quad (O^{-})$$

wherein R3 is selected from an alkyl, hydroxyalkyl, acylamidopropoyl and alkyl phenyl group, or mixtures thereof, containing from 8 to 26 carbon atoms, preferably 8 to 18 carbon atoms; R4 is an alkylene or hydroxyalkylene group containing from 2 to 3 carbon atoms, preferably 2 carbon atoms, or mixtures thereof; x is from 0 to 5, preferably from 0 to 3; and each R5 is an alkyl or hydroxyalkyl group containing from 1 to 3, preferably from 1 to 2 carbon atoms, or a polyethylene oxide group containing from 1 to 3, preferable 1, ethylene oxide groups. The R5 groups can be attached to each other, e.g., through an oxygen or nitrogen atom, to form a ring structure.

These amine oxide surfactants in particular include C10-C18 alkyl dimethyl amine oxides and C8-C18 alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are C10-C18 alkyl dimethylamine oxide, and C10-18 acylamido alkyl dimethylamine oxide.

Surfactants may be present in amounts from 0 to 10% by weight, preferably from 0.1% to 10%, and most preferably from 0.25% to 6% by weight of the total composition.

Builder

Builders for use herein include phosphate builders and phosphate free builders. If present, builders are used in a level of from 5 to 60%, preferably from 10 to 50%, more preferably from 10 to 50% by weight of the composition. In some embodiments the product comprises a mixture of phosphate and non-phosphate builders.

Phosphate Builders

Preferred phosphate builders include mono-phosphates, di-phosphates, tri-polyphosphates or oligomeric-poylphosphates are used. The alkali metal salts of these compounds are preferred, in particular the sodium salts. An especially preferred builder is sodium tripolyphosphate (STPP).

Non-phosphate Builders

Preferred non-phosphate builders include amino acid based compounds, in particular MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred. Preferabaly MGDA or GLDA are present in the composition of the invention in a level of from 0.5% to 20%, more preferably from about 1% to about 10% and especially from about 2 to about 7% by weight of the composition.

Suitable builders for use herein, in addition or instead of MGDA and/or GLDA, include builders which forms water-soluble hardness ion complexes (sequestering builder) such as citrates and builders which forms hardness precipitates (precipitating builder) such as carbonates e.g. sodium carbonate.

Other suitable non-phosphate builders include amino acid based compound or a succinate based compound. The term "succinate based compound" and "succinic acid based compound" are used interchangeably herein. Other suitable builders are described in U.S. Pat. No. 6,426,229. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Preferably the non-phosphate builder is present in the composition in an amount of at least 1%, more preferably at least 5%, even more preferably at least 10%, and most especially at least 20% by weight of the total composition. Preferably these builders are present in an amount of up to 50%, more preferably up to 45%, even more preferably up to 40%, and especially up to 35% by weight of the total composition. In preferred embodiments the composition contains 20% by weight of the total composition or less of phosphate builders, more preferably 10% by weight of the total composition or less, most preferably they are substantially free of phosphate builders.

Other non-phosphate builders include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Anti-scaling Polymer

The polymer, if present, is used in any suitable amount from about 0.1% to about 50%, preferably from 0.5% to about 20%, more preferably from 1% to 10% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

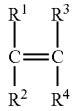

(I)

wherein R1 to R4 are independently hydrogen, methyl, carboxylic acid group or CH2COOH and wherein the carboxylic acid groups can be neutralized; (b) optionally, one or more structural units derived from at least one nonionic monomer having the general formula (II):

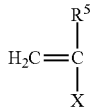

(II)

wherein R5 is hydrogen, C1 to C6 alkyl, or C1 to C6 hydroxyalkyl, and X is either aromatic (with R5 being hydrogen or methyl when X is aromatic) or X is of the general formula (III):

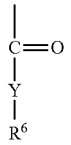

(III)

wherein R6 is (independently of R5) hydrogen, C1 to C6 alkyl, or C1 to C6 hydroxyalkyl, and Y is O or N; and at least one structural unit derived from at least one sulfonic acid monomer having the general formula (IV):

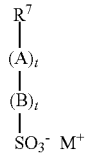

(IV)

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Silicates

Preferred silicates are sodium silicates such as sodium disilicate, sodium metasilicate and crystalline phyllosilicates. Silicates if present are at a level of from about 1 to about 20%, preferably from about 5 to about 15% by weight of composition.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 10%, preferably from about 0.5 to about 2% by weight of the total composition.

Bleach Catalyst

Bleach catalysts preferred for use herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16. Bleach catalyst if included in the compositions of the invention are in a level of from about 0.1 to about 10%, preferably from about 0.5 to about 2% by weight of the total composition.

Metal Care Agents

Metal care agents may prevent or reduce the tarnishing, corrosion or oxidation of metals, including aluminium, stainless steel and non-ferrous metals, such as silver and copper. Suitable examples include one or more of the following:

(a) benzatriazoles, including benzotriazole or bis-benzotriazole and substituted derivatives thereof. Benzotriazole derivatives are those compounds in which the available substitution sites on the aromatic ring are partially or completely substituted. Suitable substituents include linear or branch-chain C1-C20-alkyl groups and hydroxyl, thio, phenyl or halogen such as fluorine, chlorine, bromine and iodine.

(b) metal salts and complexes chosen from the group consisting of zinc, manganese, titanium, zirconium, hafnium, vanadium, cobalt, gallium and cerium salts and/or complexes, the metals being in one of the oxidation states II, III, IV, V or VI. In one aspect, suitable metal salts and/or metal complexes may be chosen from the group consisting of Mn(II) sulphate, Mn(II) citrate, Mn(II) stearate, Mn(II) acetylacetonate, K2TiF6, K2ZrF6, CoSO4, Co(NO3)2 and Ce(NO3)3, zinc salts, for example zinc sulphate, hydrozincite or zinc acetate.;

(c) silicates, including sodium or potassium silicate, sodium disilicate, sodium metasilicate, crystalline phyllosilicate and mixtures thereof.

Further suitable organic and inorganic redox-active substances that act as silver/copper corrosion inhibitors are disclosed in WO 94/26860 and WO 94/26859.

Preferably the composition of the invention comprises from 0.1 to 5%, more preferably from 0.2 to 4% and specially from 0.3 to 3% by weight of the total composition of a metal care agent, preferably the metal care agent is a zinc salt.

Unit Dose Form

Preferably the product of the invention is a unit-dose product. Products in unit dose form include tablets, capsules, sachets, pouches, etc. Preferred for use herein are tablets and unit dose form wrapped with a water-soluble film (including wrapped tablets, capsules, sachets, pouches) and injection moulded containers. The unit dose form of the invention is preferably a water-soluble multi-compartment pack.

A multi-compartments pack is formed by a plurality of water-soluble enveloping materials which form a plurality of compartments, one of the compartments would contain the composition of the invention, another compartment can contain a liquid composition, the liquid composition can be aqueous (i.e. comprises more than 10% of water by weight of the liquid composition) and the compartment can be made of warm water soluble material. In some embodiments the compartment comprising the composition of the invention is made of cold water soluble material. It allows for the separation and controlled release of different ingredients. In other embodiments all the compartments are made of warm water soluble material.

Preferred packs comprise at least two side-by-side compartments superposed (i.e., placed above) onto another compartment, especially preferred are pouches. This disposition contributes to the compactness, robustness and strength of the pack, additionally, it minimise the amount of water-soluble material required. It only requires three pieces of material to form three compartments. The robustness of the pack allows also for the use of very thin films without compromising the physical integrity of the pack. The pack is also very easy to use because the compartments do not need to be folded to be used in machine dispensers of fix geometry. At least two of the compartments of the pack contain two different compositions. By "different compositions" herein is meant compositions that differ in at least one ingredient.

Preferably, at least one of the compartments contains a solid composition and another compartment an aqueous liquid composition, the compositions are preferably in a solid to liquid weight ratio of from about 20:1 to about 1:20, more preferably from about 18:1 to about 2:1 and even more preferably from about 15:1 to about 5:1. This kind of pack is very versatile because it can accommodate compositions having a broad spectrum of values of solid:liquid ratio. Particularly preferred have been found to be pouches having a high solid:liquid ratio because many of the detergent ingredients are most suitable for use in solid form, preferably in powder form. The ratio solid:liquid defined herein refers to the relationship between the weight of all the solid compositions and the weight of all the liquid compositions in the pack.

Preferably solid:liquid weight ratio is from about 2:1 to about 18:1, more preferably from about 5:1 to about 15:1. These weight ratios are suitable in cases in which most of the ingredients of the detergent are in liquid form.

Preferably the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons, especially in an automatic dishwasher, the unit dose form products herein have a square or rectangular base and a height of from about 1 to about 5 cm, more preferably from about 1 to about 4 cm. Preferably the weight of the solid composition is from about 5 to about 20 grams, more preferably from about 10 to about 15 grams and the weight of the liquid compositions is from about 0.5 to about 4 grams, more preferably from about 0.8 to about 3 grams.

In preferred embodiments, at least two of the films which form different compartments have different solubility, under the same conditions, releasing the content of the compositions which they partially or totally envelope at different times.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. Nos. 4,765,916 and 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment pouches with different compartments, where the compartments are made of films having different solubility are taught in WO 02/08380.

All the percentages here in are by weight of the composition, unless stated otherwise.

EXAMPLES

Abbreviations Used in the Example

In the example, the abbreviated component identifications have the following meanings:

| | |
|---|---|
| Carbonate: | Anhydrous sodium carbonate |
| STPP: | Sodium tripolyphosphate anhydrous |
| Silicate: | Amorphous Sodium Silicate ($SiO_2$:$Na_2O$ = from 2:1 to 4:1) |
| Alcosperse 240-D: | Sulfonated polymer available from Alco Chemical 95% solids |
| Percarbonate: | Sodium percarbonate with a 6% sodium sulphate coating |
| TAED: | Tetraacetylethylenediamine |
| SLF18: | Non-ionic surfactant available from BASF |
| DPG: | Dipropylene glycol |

In the following example all levels are quoted in percent by weight of the composition (either solid or liquid composition).

Example 1

The composition tabulated below is introduced into a multi-compartment pouch having a first compartment comprising a solid composition (in powder form) and a liquid compartment superposed onto the powder compartment comprising a liquid composition. The pouch is made of Monosol M8630, supplied by Monosol. The weight of the solid composition is 17 grams and the weight of liquid compositions is 2 grams.

| Ingredient | Level (% wt) |
|---|---|
| Solid composition | |
| STPP | 40 |
| Carbonate | 24 |
| Silicate | 7 |
| TAED | 0.5 |
| Zinc carbonate | 0.5 |
| SLF18 | 1.5 |
| Percarbonate | 15 |
| Alcosperse 240D | 10 |
| Protease granulate | 0.5 |
| Amylase granulate | 0.5 |
| Non-ionic surfactant | 0.5 |
| Processing aids | To balance |

-continued

| Ingredient | Level (% wt) |
|---|---|
| Liquid composition | |
| DPG | 5 |
| Non-ionic surfactant | 75 |
| Amino oxide surfactant | 8 |
| Glycerine | 2 |
| Water | 10 |
| Processing aids | To balance |

The granules containing proteases and amylases according to the invention are made according to the process described in US 2008/0206830A1. The powder for the pouch of example 1 has good processing properties and it is stable in storage. The composition provides excellent cleaning.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 5

<210> SEQ ID NO 1
<211> LENGTH: 269
<212> TYPE: PRT
<213> ORGANISM: Bacillus Alkalophilus PB92

<400> SEQUENCE: 1

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Asn Ala Glu Leu Tyr Ala Val Lys Val Leu Gly Ala
                85                  90                  95

Ser Gly Ser Gly Ser Val Ser Ser Ile Ala Gln Gly Leu Glu Trp Ala
            100                 105                 110

Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Gly Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
```

```
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265


<210> SEQ ID NO 2
<211> LENGTH: 485
<212> TYPE: PRT
<213> ORGANISM: Bacillus AA560

<400> SEQUENCE: 2

His His Asn Gly Thr Asn Gly Thr Met Met Gln Tyr Phe Glu Trp Tyr
1               5                   10                  15

Leu Pro Asn Asp Gly Asn His Trp Asn Arg Leu Arg Ser Asp Ala Ser
            20                  25                  30

Asn Leu Lys Asp Lys Gly Ile Ser Ala Val Trp Ile Pro Pro Ala Trp
        35                  40                  45

Lys Gly Ala Ser Gln Asn Asp Val Gly Tyr Gly Ala Tyr Asp Leu Tyr
    50                  55                  60

Asp Leu Gly Glu Phe Asn Gln Lys Gly Thr Ile Arg Thr Lys Tyr Gly
65                  70                  75                  80

Thr Arg Asn Gln Leu Gln Ala Ala Val Asn Ala Leu Lys Ser Asn Gly
                85                  90                  95

Ile Gln Val Tyr Gly Asp Val Val Met Asn His Lys Gly Gly Ala Asp
            100                 105                 110

Ala Thr Glu Met Val Arg Ala Val Glu Val Asn Pro Asn Asn Arg Asn
        115                 120                 125

Gln Glu Val Ser Gly Glu Tyr Thr Ile Glu Ala Trp Thr Lys Phe Asp
    130                 135                 140

Phe Pro Gly Arg Gly Asn Thr His Ser Asn Phe Lys Trp Arg Trp Tyr
145                 150                 155                 160

His Phe Asp Gly Val Asp Trp Asp Gln Ser Arg Lys Leu Asn Asn Arg
                165                 170                 175

Ile Tyr Lys Phe Arg Gly Asp Gly Lys Gly Trp Asp Trp Glu Val Asp
            180                 185                 190

Thr Glu Asn Gly Asn Tyr Asp Tyr Leu Met Tyr Ala Asp Ile Asp Met
        195                 200                 205

Asp His Pro Glu Val Val Asn Glu Leu Arg Asn Trp Gly Val Trp Tyr
    210                 215                 220

Thr Asn Thr Leu Gly Leu Asp Gly Phe Arg Ile Asp Ala Val Lys His
225                 230                 235                 240

Ile Lys Tyr Ser Phe Thr Arg Asp Trp Ile Asn His Val Arg Ser Ala
                245                 250                 255

Thr Gly Lys Asn Met Phe Ala Val Ala Glu Phe Trp Lys Asn Asp Leu
            260                 265                 270

Gly Ala Ile Glu Asn Tyr Leu Asn Lys Thr Asn Trp Asn His Ser Val
        275                 280                 285

Phe Asp Val Pro Leu His Tyr Asn Leu Tyr Asn Ala Ser Lys Ser Gly
    290                 295                 300

Gly Asn Tyr Asp Met Arg Gln Ile Phe Asn Gly Thr Val Val Gln Arg
305                 310                 315                 320

His Pro Met His Ala Val Thr Phe Val Asp Asn His Asp Ser Gln Pro
```

```
                325                 330                 335

Glu Glu Ala Leu Glu Ser Phe Val Glu Glu Trp Phe Lys Pro Leu Ala
            340                 345                 350

Tyr Ala Leu Thr Leu Thr Arg Glu Gln Gly Tyr Pro Ser Val Phe Tyr
        355                 360                 365

Gly Asp Tyr Tyr Gly Ile Pro Thr His Gly Val Pro Ala Met Lys Ser
    370                 375                 380

Lys Ile Asp Pro Ile Leu Glu Ala Arg Gln Lys Tyr Ala Tyr Gly Arg
385                 390                 395                 400

Gln Asn Asp Tyr Leu Asp His His Asn Ile Ile Gly Trp Thr Arg Glu
                405                 410                 415

Gly Asn Thr Ala His Pro Asn Ser Gly Leu Ala Thr Ile Met Ser Asp
            420                 425                 430

Gly Ala Gly Gly Asn Lys Trp Met Phe Val Gly Arg Asn Lys Ala Gly
        435                 440                 445

Gln Val Trp Thr Asp Ile Thr Gly Asn Arg Ala Gly Thr Val Thr Ile
    450                 455                 460

Asn Ala Asp Gly Trp Gly Asn Phe Ser Val Asn Gly Gly Ser Val Ser
465                 470                 475                 480

Ile Trp Val Asn Lys
                485


<210> SEQ ID NO 3
<211> LENGTH: 483
<212> TYPE: PRT
<213> ORGANISM: Bacillus Licheniformis

<400> SEQUENCE: 3

Ala Asn Leu Asn Gly Thr Leu Met Gln Tyr Phe Glu Trp Tyr Met Pro
1               5                   10                  15

Asn Asp Gly Gln His Trp Arg Arg Leu Gln Asn Asp Ser Ala Tyr Leu
            20                  25                  30

Ala Glu His Gly Ile Thr Ala Val Trp Ile Pro Pro Ala Tyr Lys Gly
        35                  40                  45

Thr Ser Gln Ala Asp Val Gly Tyr Gly Ala Tyr Asp Leu Tyr Asp Leu
    50                  55                  60

Gly Glu Phe His Gln Lys Gly Thr Val Arg Thr Lys Tyr Gly Thr Lys
65                  70                  75                  80

Gly Glu Leu Gln Ser Ala Ile Lys Ser Leu His Ser Arg Asp Ile Asn
                85                  90                  95

Val Tyr Gly Asp Val Val Ile Asn His Lys Gly Gly Ala Asp Ala Thr
            100                 105                 110

Glu Asp Val Thr Ala Val Glu Val Asp Pro Ala Asp Arg Asn Arg Val
        115                 120                 125

Ile Ser Gly Glu His Arg Ile Lys Ala Trp Thr His Phe His Phe Pro
    130                 135                 140

Gly Arg Gly Ser Thr Tyr Ser Asp Phe Lys Trp His Trp Tyr His Phe
145                 150                 155                 160

Asp Gly Thr Asp Trp Asp Glu Ser Arg Lys Leu Asn Arg Ile Tyr Lys
                165                 170                 175

Phe Gln Gly Lys Ala Trp Asp Trp Glu Val Ser Asn Glu Asn Gly Asn
            180                 185                 190

Tyr Asp Tyr Leu Met Tyr Ala Asp Ile Asp Tyr Asp His Pro Asp Val
        195                 200                 205

Ala Ala Glu Ile Lys Arg Trp Gly Thr Trp Tyr Ala Asn Glu Leu Gln
```

```
    210                 215                 220

Leu Asp Gly Phe Arg Leu Asp Ala Val Lys His Ile Lys Phe Ser Phe
225                 230                 235                 240

Leu Arg Asp Trp Val Asn His Val Arg Glu Lys Thr Gly Lys Glu Met
                245                 250                 255

Phe Thr Val Ala Glu Tyr Trp Gln Asn Asp Leu Gly Ala Leu Glu Asn
            260                 265                 270

Tyr Leu Asn Lys Thr Asn Phe Asn His Ser Val Phe Asp Val Pro Leu
        275                 280                 285

His Tyr Gln Phe His Ala Ala Ser Thr Gln Gly Gly Gly Tyr Asp Met
    290                 295                 300

Arg Lys Leu Leu Asn Ser Thr Val Val Ser Lys His Pro Leu Lys Ala
305                 310                 315                 320

Val Thr Phe Val Asp Asn His Asp Thr Gln Pro Gly Gln Ser Leu Glu
                325                 330                 335

Ser Thr Val Gln Thr Trp Phe Lys Pro Leu Ala Tyr Ala Phe Ile Leu
            340                 345                 350

Thr Arg Glu Ser Gly Tyr Pro Gln Val Phe Tyr Gly Asp Met Tyr Gly
        355                 360                 365

Thr Lys Gly Asp Ser Gln Arg Glu Ile Pro Ala Leu Lys His Lys Ile
    370                 375                 380

Glu Pro Ile Leu Lys Ala Arg Lys Gln Tyr Ala Tyr Gly Ala Gln His
385                 390                 395                 400

Asp Tyr Phe Asp His His Asp Ile Val Gly Trp Thr Arg Glu Gly Asp
                405                 410                 415

Ser Ser Val Ala Asn Ser Gly Leu Ala Ala Leu Ile Thr Asp Gly Pro
            420                 425                 430

Gly Gly Ala Lys Arg Met Tyr Val Gly Arg Gln Asn Ala Gly Glu Thr
        435                 440                 445

Trp His Asp Ile Thr Gly Asn Arg Ser Glu Pro Val Val Ile Asn Ser
    450                 455                 460

Glu Gly Trp Gly Glu Phe His Val Asn Gly Gly Ser Val Ser Ile Tyr
465                 470                 475                 480

Val Gln Arg


<210> SEQ ID NO 4
<211> LENGTH: 269
<212> TYPE: PRT
<213> ORGANISM: Bacillus lentus

<400> SEQUENCE: 4

Ala Gln Ser Val Pro Trp Gly Ile Ser Arg Val Gln Ala Pro Ala Ala
1               5                   10                  15

His Asn Arg Gly Leu Thr Gly Ser Gly Val Lys Val Ala Val Leu Asp
            20                  25                  30

Thr Gly Ile Ser Thr His Pro Asp Leu Asn Ile Arg Gly Gly Ala Ser
        35                  40                  45

Phe Val Pro Gly Glu Pro Ser Thr Gln Asp Gly Asn Gly His Gly Thr
    50                  55                  60

His Val Ala Gly Thr Ile Ala Ala Leu Asn Asn Ser Ile Gly Val Leu
65                  70                  75                  80

Gly Val Ala Pro Ser Ala Glu Leu Tyr Ala Val Lys Val Leu Gly Ala
                85                  90                  95

Asp Gly Arg Gly Ala Ile Ser Ser Ile Ala Gln Gly Leu Glu Trp Ala
            100                 105                 110
```

```
Gly Asn Asn Gly Met His Val Ala Asn Leu Ser Leu Gly Ser Pro Ser
        115                 120                 125

Pro Ser Ala Thr Leu Glu Gln Ala Val Asn Ser Ala Thr Ser Arg Gly
    130                 135                 140

Val Leu Val Val Ala Ala Ser Gly Asn Ser Gly Ala Ser Ser Ile Ser
145                 150                 155                 160

Tyr Pro Ala Arg Tyr Ala Asn Ala Met Ala Val Gly Ala Thr Asp Gln
                165                 170                 175

Asn Asn Asn Arg Ala Ser Phe Ser Gln Tyr Gly Ala Gly Leu Asp Ile
            180                 185                 190

Val Ala Pro Gly Val Asn Val Gln Ser Thr Tyr Pro Gly Ser Thr Tyr
        195                 200                 205

Ala Ser Leu Asn Gly Thr Ser Met Ala Thr Pro His Val Ala Gly Ala
    210                 215                 220

Ala Ala Leu Val Lys Gln Lys Asn Pro Ser Trp Ser Asn Val Gln Ile
225                 230                 235                 240

Arg Asn His Leu Lys Asn Thr Ala Thr Ser Leu Gly Ser Thr Asn Leu
                245                 250                 255

Tyr Gly Ser Gly Leu Val Asn Ala Glu Ala Ala Thr Arg
            260                 265


<210> SEQ ID NO 5
<211> LENGTH: 485
<212> TYPE: PRT
<213> ORGANISM: Bacillus sp. 707

<400> SEQUENCE: 5

His His Asn Gly Thr Asn Gly Thr Met Met Gln Tyr Phe Glu Trp Tyr
1               5                   10                  15

Leu Pro Asn Asp Gly Asn His Trp Asn Arg Leu Asn Ser Asp Ala Ser
            20                  25                  30

Asn Leu Lys Ser Lys Gly Ile Thr Ala Val Trp Ile Pro Pro Ala Trp
        35                  40                  45

Lys Gly Ala Ser Gln Asn Asp Val Gly Tyr Gly Ala Tyr Asp Leu Tyr
    50                  55                  60

Asp Leu Gly Glu Phe Asn Gln Lys Gly Thr Val Arg Thr Lys Tyr Gly
65                  70                  75                  80

Thr Arg Ser Gln Leu Gln Ala Ala Val Thr Ser Leu Lys Asn Asn Gly
                85                  90                  95

Ile Gln Val Tyr Gly Asp Val Val Met Asn His Lys Gly Gly Ala Asp
            100                 105                 110

Ala Thr Glu Met Val Arg Ala Val Glu Val Asn Pro Asn Asn Arg Asn
        115                 120                 125

Gln Glu Val Thr Gly Glu Tyr Thr Ile Glu Ala Trp Thr Arg Phe Asp
    130                 135                 140

Phe Pro Gly Arg Gly Asn Thr His Ser Ser Phe Lys Trp Arg Trp Tyr
145                 150                 155                 160

His Phe Asp Gly Val Asp Trp Asp Gln Ser Arg Arg Leu Asn Asn Arg
                165                 170                 175

Ile Tyr Lys Phe Arg Gly His Gly Lys Ala Trp Asp Trp Glu Val Asp
            180                 185                 190

Thr Glu Asn Gly Asn Tyr Asp Tyr Leu Met Tyr Ala Asp Ile Asp Met
        195                 200                 205

Asp His Pro Glu Val Val Asn Glu Leu Arg Asn Trp Gly Val Trp Tyr
    210                 215                 220
```

-continued

```
Thr Asn Thr Leu Gly Leu Asp Gly Phe Arg Ile Asp Ala Val Lys His
225                 230                 235                 240

Ile Lys Tyr Ser Phe Thr Arg Asp Trp Ile Asn His Val Arg Ser Ala
                245                 250                 255

Thr Gly Lys Asn Met Phe Ala Val Ala Glu Phe Trp Lys Asn Asp Leu
            260                 265                 270

Gly Ala Ile Glu Asn Tyr Leu Gln Lys Thr Asn Trp Asn His Ser Val
        275                 280                 285

Phe Asp Val Pro Leu His Tyr Asn Leu Tyr Asn Ala Ser Lys Ser Gly
    290                 295                 300

Gly Asn Tyr Asp Met Arg Asn Ile Phe Asn Gly Thr Val Val Gln Arg
305                 310                 315                 320

His Pro Ser His Ala Val Thr Phe Val Asp Asn His Asp Ser Gln Pro
                325                 330                 335

Glu Glu Ala Leu Glu Ser Phe Val Glu Glu Trp Phe Lys Pro Leu Ala
            340                 345                 350

Tyr Ala Leu Thr Leu Thr Arg Glu Gln Gly Tyr Pro Ser Val Phe Tyr
        355                 360                 365

Gly Asp Tyr Tyr Gly Ile Pro Thr His Gly Val Pro Ala Met Arg Ser
    370                 375                 380

Lys Ile Asp Pro Ile Leu Glu Ala Arg Gln Lys Tyr Ala Tyr Gly Lys
385                 390                 395                 400

Gln Asn Asp Tyr Leu Asp His His Asn Ile Ile Gly Trp Thr Arg Glu
                405                 410                 415

Gly Asn Thr Ala His Pro Asn Ser Gly Leu Ala Thr Ile Met Ser Asp
            420                 425                 430

Gly Ala Gly Gly Ser Lys Trp Met Phe Val Gly Arg Asn Lys Ala Gly
        435                 440                 445

Gln Val Trp Ser Asp Ile Thr Gly Asn Arg Thr Gly Thr Val Thr Ile
    450                 455                 460

Asn Ala Asp Gly Trp Gly Asn Phe Ser Val Asn Gly Gly Ser Val Ser
465                 470                 475                 480

Ile Trp Val Asn Lys
                485
```

What is claimed is:

1. An automatic dishwashing detergent composition comprising by weight of the composition:

a) at least 9% of coated bleach particles the particles having a coating comprising at least 5% by weight of the particle of an efflorescent material;

b) at least 0.5% of granulates containing active enzyme wherein the granulates comprise at least 30% of efflorescent material by weight of the granulate and wherein the efflorescent material and the active enzyme are in a weight ratio of at least 4:1; and wherein the efflorescent material is selected from the group consisting of sodium citrate, sodium sulphate and mixtures thereof.

2. A composition according to claim 1 further comprising from 0.1 to 5% of an ethoxylated/propoxylated non ionic surfactant by weight of the composition.

3. A composition according to claim 1 wherein the automatic dishwashing detergent composition is in unit dose form.

4. A composition according to claim 1 wherein the weight of the composition is less than about 20 grams.

5. A composition according to claim 1 wherein the bleach is an inorganic peroxide.

6. A composition according to claim 1 wherein the composition is free of phosphate and comprises a non-phosphate detergent builder.

7. A composition according to claim 1 wherein the composition comprises an anti-scaling polymer.

8. A composition according to claim 1 wherein said active enzyme comprises low temperature amylase and/or low temperature protease.

9. A composition according to claim 8 wherein the low temperature amylase is an amylase variant comprising either:

(a) one or more substitutions in the following positions versus SEQ ID NO: 2: 9, 26, 149, 182, 186, 202, 257, 295, 299, 323, 339 and 345; and (b) optionally with one or more substitutions and/or deletions in the following positions: 118, 183, 184, 195, 320 and 458;

or:

(c) at least one substitution in the following positions versus SEQ ID NO:5: M202 , M208, S255, R172, and/or M261.

10. A composition according to claim 8 wherein the low temperature protease is selected from the group consisting of the below mutations versus SEQ ID NO:1, wherein the mutation numbering is directly versus SEQ ID NO:1, rather than against BPN' numbering:

(i) G116V+S126L+P127Q+S128A
(ii) G116V+S126N+P127S+S128A +5160D
(iii) G116V+S126L+P127Q+S128A +5160D
(iv) G116V+S126V+P127E+S128K
(v) G116V+S126V+P127M+S160D
(vi) G116V+S126F+P127L+S128T
(vii) G116V+S126L+P127N+S128V
(viii) G116V+S126F+P127Q
(ix) G116V+S126V+P127E+S128K+5160D
(x) G116V+S126R+P127S+S128P
(xi) S126R+P127Q+S128D
(xii) S126C+P127R+S128D
(xiii) S126C+P127R+S128G.

11. A process for making a detergent composition according to claim 1 wherein the process comprises the steps of:

a) preparing a powder; and using the powder of step a) to make a product unit dose form.

12. An automatic dishwashing detergent composition comprising by weight of the composition:

a) at least 9% of coated bleach particles the particles having a coating comprising at least 5% by weight of the particle of an efflorescent material;

b) at least 0.5% of granulates containing active enzyme wherein the granulates comprise at least 50% of efflorescent material; and wherein the efflorescent material is selected from the group consisting of sodium citrate, sodium sulphate and mixtures thereof.

13. A composition according to claim 12 further comprising from 0.1 to 5% of an ethoxylated/propoxylated non ionic surfactant by weight of the composition.

14. A composition according to claim 12 wherein the automatic dishwashing detergent composition is in unit dose form, preferably in the form of a tablet or a water-soluble sachet.

15. A composition according to claim 12 wherein the weight of the composition is less than about 20 grams.

16. A composition according to claim 12 wherein the bleach is an inorganic peroxide.

17. A composition according to claim 12 wherein the efflorescent material is selected from the group consisting of sodium citrate, sodium sulphate and mixtures thereof.

18. A composition according to claim 12 wherein the composition is free of phosphate and comprises a non-phosphate detergent builder.

19. A composition according to claim 12 wherein the composition comprises an anti-scaling polymer.

20. A composition according to claim 12 wherein said active enzyme comprises low temperature amylase and/or low temperature protease.

21. A composition according to claim 20 wherein the low temperature amylase is an amylase variant comprising either:

(a) one or more substitutions in the following positions versus SEQ ID NO: 2: 9, 26, 149, 182, 186, 202, 257, 295, 299, 323, 339 and 345; and (b) optionally with one or more substitutions and/or deletions in the following positions: 118, 183, 184, 195, 320 and 458;

or:

(c) at least one substitution in the following positions versus SEQ ID NO:5: M202, M208, S255, R172, and/or M261.

22. A composition according to claim 20 wherein the low temperature protease is selected from the group consisting of the below mutations versus SEQ ID NO:1, wherein the mutation numbering is directly versus SEQ ID NO:1, rather than against BPN' numbering:

(i) G116V+S126L+P127Q+S128A
(ii) G116V+S126N+P127S+S128A +S160D
(iii) G116V+S126L+P127Q+S128A +S160D
(iv) G116V+S126V+P127E+S128K
(v) G116V+S126V+P127M+S160D
(vi) G116V+S126F+P127L+S128T
(vii) G116V+S126L+P127N+S128V
(viii) G116V+S126F+P127Q
(ix) G116V+S126V+P127E+S128K+S160D
(x) G116V+S126R+P127S+S128P
(xi) S126R+P127Q+S128D
(xii) S126C+P127R+S128D
(xiii) S126C+P127R+S128G.

23. A process for making a detergent composition according to claim 12 wherein the process comprises the steps of:

a) preparing a powder; and using the powder of step a) to make a product unit dose form.

* * * * *

UNITED STATES PATENT AND TRADEMARK OFFICE

CERTIFICATE OF CORRECTION

PATENT NO. : 8,697,623 B2
APPLICATION NO. : 13/867280
DATED : April 15, 2014
INVENTOR(S) : Souter et al.

It is certified that error appears in the above-identified patent and that said Letters Patent is hereby corrected as shown below:

In the Claims

Column 35
Line 7, delete "5160D" and insert -- S160D --.

Column 35
Line 8, delete "5160D" and insert -- S160D --.

Signed and Sealed this
Twenty-fourth Day of June, 2014

Michelle K. Lee

Michelle K. Lee
*Deputy Director of the United States Patent and Trademark Office*